US010658788B2

(12) United States Patent
Hida

(10) Patent No.: US 10,658,788 B2
(45) Date of Patent: May 19, 2020

(54) COVER WITH INTERLOCK CONNECTOR

(71) Applicant: DENSO CORPORATION, Kariya, Aichi-pref. (JP)

(72) Inventor: Kenshiro Hida, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/594,170

(22) Filed: Oct. 7, 2019

(65) Prior Publication Data

US 2020/0036131 A1 Jan. 30, 2020

Related U.S. Application Data

(63) Continuation of application No. PCT/JP2018/012487, filed on Mar. 27, 2018.

(30) Foreign Application Priority Data

Apr. 5, 2017 (JP) ..... 2017-075530

(51) Int. Cl.

| | |
|---|---|
| ***H01R 33/00*** | (2006.01) |
| ***H01R 13/52*** | (2006.01) |
| ***H01R 13/6591*** | (2011.01) |
| ***H01R 13/74*** | (2006.01) |

(52) U.S. Cl.

CPC ..... *H01R 13/5213* (2013.01); *H01R 13/6591* (2013.01); *H01R 13/74* (2013.01)

(58) Field of Classification Search

CPC ..... H01R 31/02; H01R 25/006; H01R 13/41; H01R 35/04; H01R 13/62938; H01R 13/62933

USPC ..... 439/652, 539, 538, 733.1, 131, 157, 372

See application file for complete search history.

(56) References Cited

U.S. PATENT DOCUMENTS

| | | | | |
|---|---|---|---|---|
| 5,664,955 A * | 9/1997 | Arnett | G02B 6/3817 | 174/67 |
| 5,882,220 A * | 3/1999 | Horii | G06F 1/1632 | 361/679.41 |
| 6,017,228 A * | 1/2000 | Verbeek | A47B 21/06 | 174/493 |
| 6,242,697 B1 * | 6/2001 | Gerken | H02G 3/085 | 16/2.1 |
| 7,329,140 B2 * | 2/2008 | O'Connell | H01R 13/447 | 439/373 |

FOREIGN PATENT DOCUMENTS

JP 2012-248415 A 12/2012

* cited by examiner

*Primary Examiner* — Phuong Chi Thi Nguyen

(74) *Attorney, Agent, or Firm* — Oliff PLC

(57) ABSTRACT

A cover includes a cover body and an interlock connector. The cover body covers an opening provided in a case of a power conversion device and is electrically conductive. The interlock connector is electrically connectable to a receptacle connector provided inside the case. A noise shielding layer and a low conductivity layer are formed between the cover body and the interlock connector. The noise shielding layer is electrically conductive. The low conductivity layer is closer to the cover body than the noise shielding layer is, and is less electrically conductive than the cover body and the noise shielding layer.

14 Claims, 6 Drawing Sheets

COVER WITH INTERLOCK CONNECTOR

CROSS-REFERENCE TO RELATED APPLICATIONS

The present application is a continuation application of International Application No. PCT/JP2018/012487, filed Mar. 27, 2018, which claims priority to Japanese Patent Application No. 2017-075530, filed Apr. 5, 2017. The contents of these applications are incorporated herein by reference in their entirety.

BACKGROUND

Technical Field

The present disclosure relates to a cover with an interlock connector.

Related Art

In conventional techniques, a case provided in a power conversion device includes an opening for facilitating, for example, the work of fastening a bolt to a terminal through which a high-voltage current flows. After the fastening work or the like is finished, the opening is covered with a cover so that any entry of foreign matter is prevented. As a mechanism for detecting the open/closed state of the cover, an interlock mechanism is employed. The interlock mechanism includes an interlock connector provided on the cover and a receptacle connector provided inside the case. In a cover closed state, these connectors are electrically connected to each other. In a cover open state, these connectors are separated from each other so as not to be electrically connected to each other.

SUMMARY

On aspect of the present disclosure provides a cover that includes a cover body and an interlock connector. The cover body is electrically conductive and covers an opening provided in a case of a power conversion device. The interlock connector is electrically connectable to a receptacle connector provided inside the case. The cover further includes a noise shielding layer and a low conductivity layer that are formed between the cover body and the interlock connector. The noise shielding layer is electrically conductive. The low conductivity layer is less electrically conductive than the cover body and the noise shielding layer, and is closer to the cover body than the noise shielding layer is.

DESCRIPTION OF THE EMBODIMENTS

Figure 1:
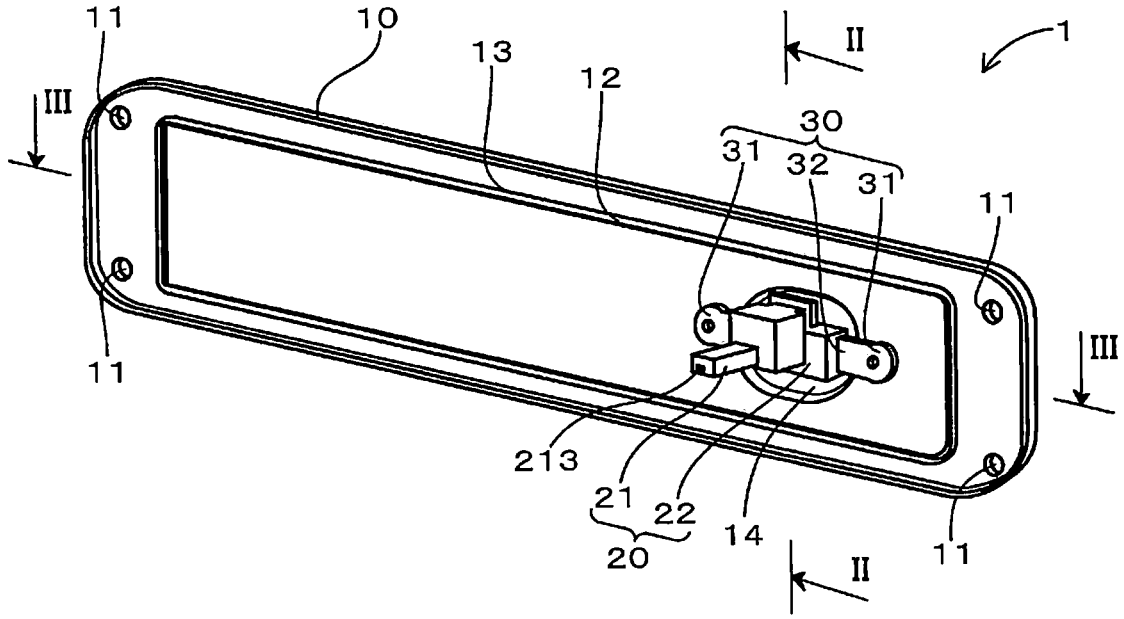
FIG. 1 is a perspective view of a cover with an interlock connector according to the first embodiment.

JP-A-2012-248415 discloses a power conversion device including such an interlock mechanism. According to the configuration disclosed in JP-A-2012-248415, the interlock connector is movably attached to the inner face of the cover, which ensures that the interlock connector is connected to the receptacle connector when the cover is closed.

According to the configuration disclosed in JP-A-2012-248415, the interlock connector is attached to the cover so that the open/closed state of the cover is detected. Thus, the interlock connector is liable to be affected by external noise in the power conversion device. Therefore, external noise can cause false detection of the open/closed state in the interlock mechanism that detects the state of electrical connection between the interlock connector and the receptacle connector.

A possible way to prevent false detection is to increase the thickness of the electrically conductive cover so that less noise reaches the interlock connector due to the internal attenuation of external noise through the cover. However, simply increasing the thickness of the cover is not very effective in subjecting low-frequency noise to internal attenuation, which is problematic not only because the cover cannot sufficiently prevent noise from reaching the interlock connector but also because the size of the device increases. These problems are particularly evident in a vehicle's power conversion device, which is susceptible to low-frequency noise from other devices in the vehicle.

It is thus desired to provide a cover with an interlock connector that prevents false detection of its open/closed state and can have a small size.

An exemplary embodiment provides a cover that includes a cover body that is electrically conductive and covers an opening provided in a case of a power conversion device; an interlock connector that is electrically connectable to a receptacle connector provided inside the case; a noise shielding layer that is formed between the cover body and the interlock connector, the noise shielding layer being electrically conductive and; and a low conductivity layer that is formed between the cover body and the interlock connector, the low conductivity layer being less electrically conductive than the cover body and the noise shielding layer, and being closer to the cover body than the noise shielding layer is.

In the cover, the electrically conductive noise shielding layer and the low conductivity layer are formed between the cover body and the interlock connector. The low conductivity layer is closer to the cover body than the noise shielding layer is, and is less electrically conductive than the cover body and the noise shielding layer. As a result, the synergy of internal attenuation through the cover body and the noise shielding layer and reflection that occurs in the low conductivity layer between the noise shielding layer and the cover body prevents external noise from reaching the interlock connector, whereby noise resistance is improved.

False detection of the open/closed state of the cover is prevented. Further, the cover body does not require an excessively large thickness. Thus, the cover with an interlock connector can have a small size. Even when external noise includes much low-frequency noise, reflection at the low conductivity layer can prevent the external noise from reaching the interlock connector. Thus, even in a vehicle that has relatively much low-frequency noise, false detection of the open/closed state of the cover with an interlock connector is prevented, and the cover with an interlock connector can have a small size.

As described above, the exemplary embodiment can provide a cover with an interlock connector that prevents false detection of its open/closed state and can have a small size.

First Embodiment

An embodiment of the above-mentioned cover with an interlock connector will be described using FIGS. 1 to 6.

Figure 4:
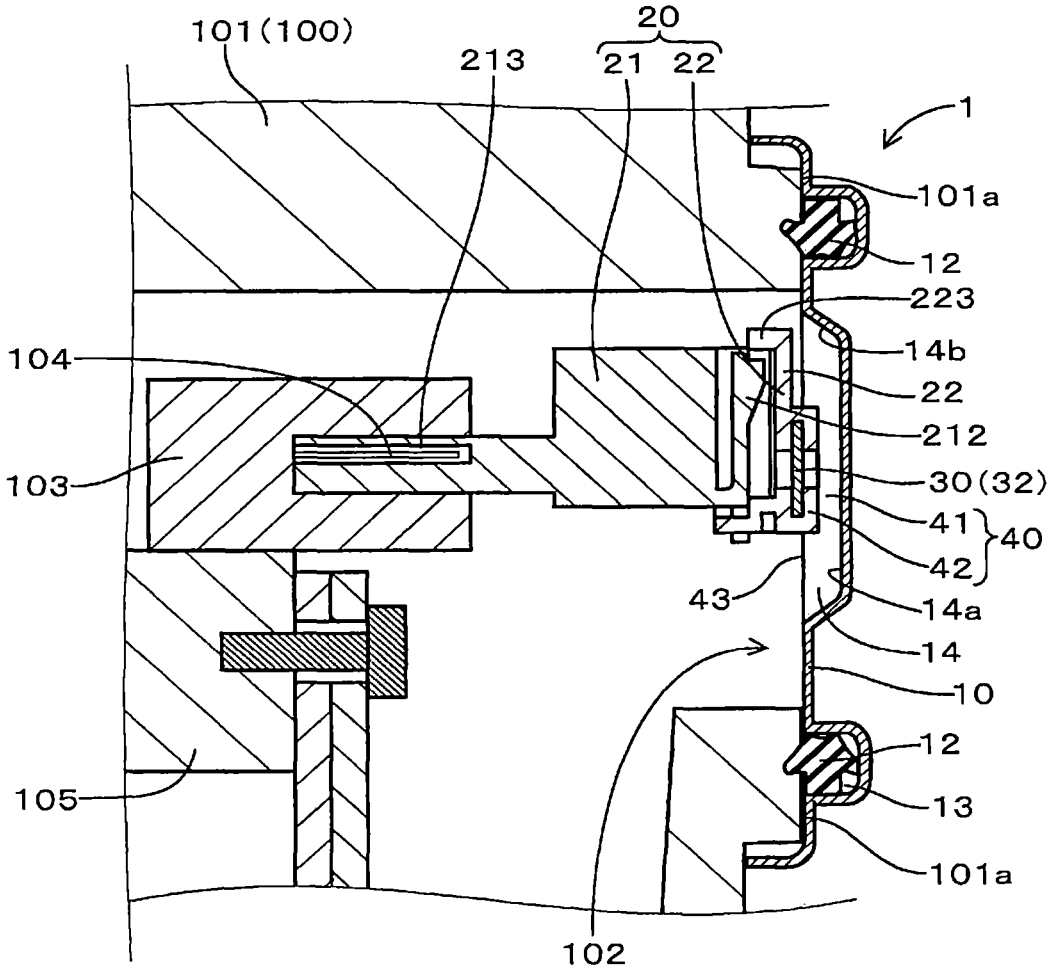
FIG. 4 is a schematic view illustrating attachment of the cover with an interlock connector according to the first embodiment.

As shown in FIG. 1, the cover 1 according to the present embodiment has a cover body 10 and an interlock connector 20. The cover body 10 is configured to cover an opening 102 provided in a case 101 of a power conversion device 100 as shown in FIG. 4 and is electrically conductive. The interlock connector 20 is configured to be electrically connectable to a receptacle connector 103 provided inside the case 101. Between the cover body 10 and the interlock connector 20, a noise shielding layer 30 and a low conductivity layer 40 are formed. The noise shielding layer 30 is electrically conductive. The low conductivity layer 40 is closer to the cover body 10 than the noise shielding layer 30 is, and is less electrically conductive than the cover body 10 and the noise shielding layer 30.

Below is a detailed description of the cover 1 according to the present embodiment.

As shown in FIG. 4, the cover 1 is attached to the case 101 of the power conversion device 100. The opening 102 is formed in the case 101, so that the work of fastening a bolt to a high-voltage terminal block 105 provided in the power conversion device 100 can be conducted through the opening 102. The shape of the cover 1 is slightly larger than the outer shape of the opening 102. The cover 1 is removably attached to the case 101 to close the opening 102.

As shown in FIG. 1, the cover body 10 is a plate-like member made of metal and is electrically conductive. The cover body 10 can have a thickness of 0.5 to 3.0 mm, for example, in consideration of the internal noise attenuation effect and moldability required. The cover body 10 preferably has a thickness of 0.5 to 1.0 mm, and is 0.5 mm in the present embodiment. The outer edge of the cover body 10 includes four fastening holes 11 for attachment to the case 101. A groove 13 in which a gasket 12 is fit is formed inside the fastening holes 11. As shown in FIG. 4, the gasket 12 is configured to abut a side face 101*a* of the case 101 to seal the space between the cover body 10 and the side face 101*a*. The cover body 10 includes a cover recess 14 with a recess shape on the side facing the opening 102.

As shown in FIG. 1, the noise shielding layer 30 includes an elongated plate-like member made of metal and is electrically conductive. The noise shielding layer 30 can have any thickness, but can have a thickness of 0.5 to 3.0 mm, for example, in consideration of the internal noise attenuation effect and moldability required. The noise shielding layer 30 preferably has a thickness of 0.5 to 1.0 mm, and is 1.0 mm in the present embodiment. The noise shielding layer 30 is provided on the side of the cover body 10 that faces the opening 102 to cover a part of the cover recess 14. The noise shielding layer 30 has connection parts 31 on its longitudinal ends. The connection parts 31 abut the cover body 10 and are electrically connected to each other.

Figure 3:
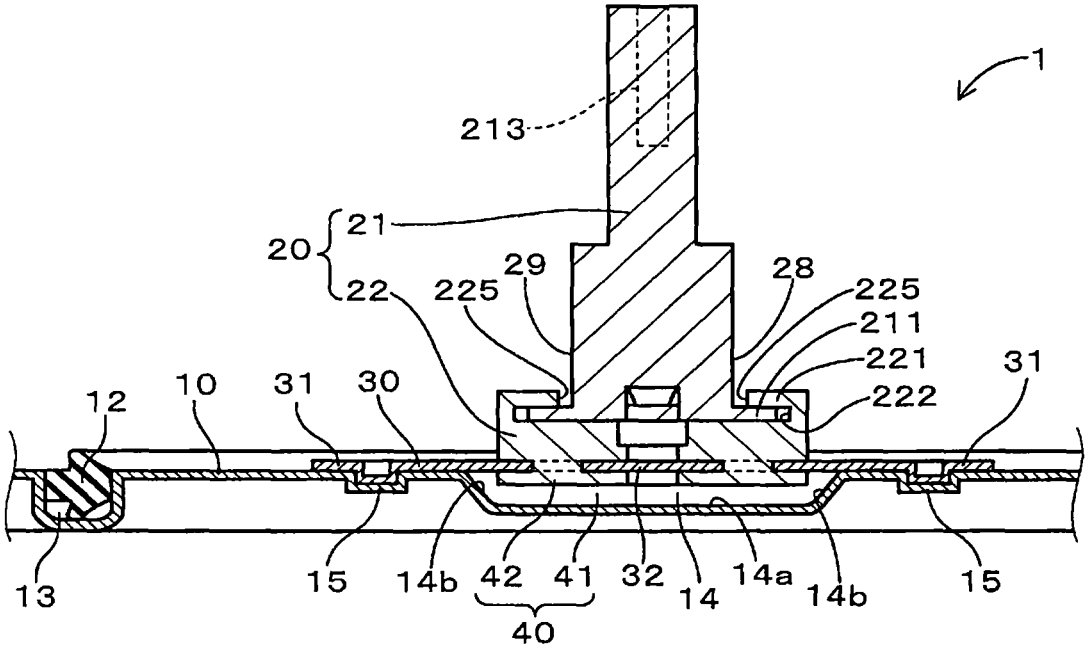
FIG. 3 is a cross-sectional view taken along line III-III in FIG. 1.

As shown in FIG. 3, the connection parts 31 are joined by clinching to the cover body 10 by being laid on and deformed integrally with the cover body 10. The method for clinch joining adopted in the present embodiment is mechanical TOX clinching. The clinch joining forms projections 15 projecting to the outside of the case 101 on the connection parts 31 and the cover body 10. The longitudinal central area of the noise shielding layer 30 constitutes a separation part 32 separated from an inner face 14*a* of the cover recess 14. The low conductivity layer 40 is formed between the separation part 32 and the inner face 14*a*.

Figure 2:
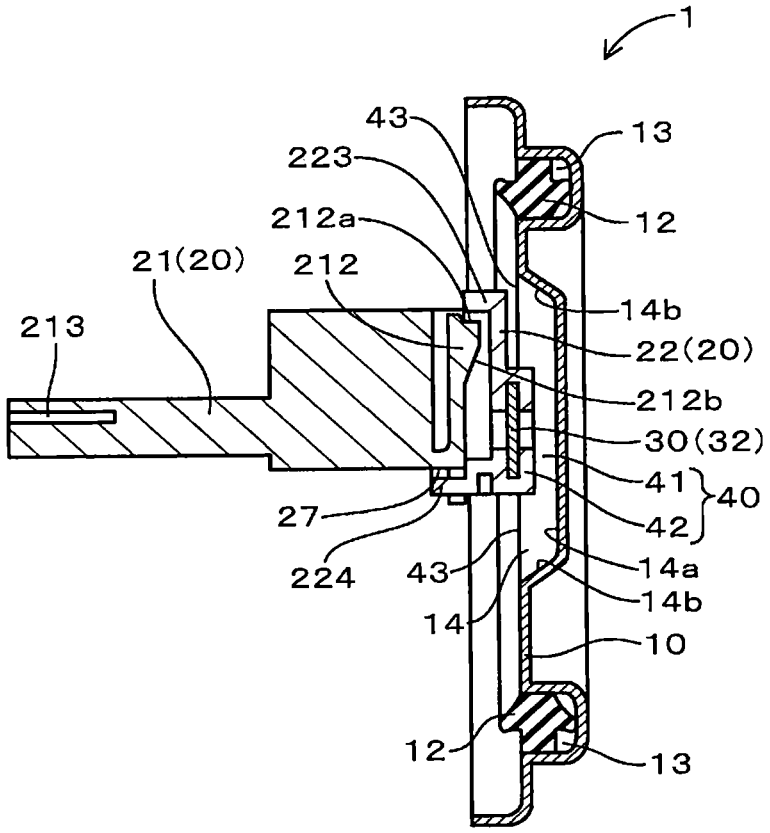
FIG. 2 is a cross-sectional view taken along line II-II in FIG. 1.

As shown in FIG. 3, the longitudinal central area of the noise shielding layer 30 is provided with a connector holder 22 (described later). The connector holder 22 is an insulating resin member and is formed by insert molding such the connector holder 22 is integrally molded (insert-molded) with the longitudinal central area of the noise shielding layer 30. The connector holder 22 has a slit 221, a first protrusion 223, and a second protrusion 224. The slit 221 has a slit shape such that an engagement rib 211 provided in a connector body 21 (described later) is engaged therewith. The first protrusion 223 projects to face a rising face 212*a* of an engagement claw 212 provided on the connector body 21 (described later) as shown in FIG. 2. The second protrusion 224 projects to face a first side face 27 of the connector body 21 opposite to the rising face 212*a*.

As shown in FIGS. 2 and 3, the low conductivity layer 40 is formed between the cover body 10 and the noise shielding layer 30. The low conductivity layer 40 is less electrically conductive than the cover body 10 and the noise shielding layer 30. For example, the low conductivity layer 40 can include an air layer defined by a space, a layer including an insulating material, a layer including a material that is less electrically conductive than the materials that form the cover body 10 and the noise shielding layer 30, or a combination of these layers.

In the present embodiment, the low conductivity layer 40 includes a space 41 between the cover body 10 and the connector holder 22 and a bulged portion (protrusion) 42. The bulged portion 42 is a part of the connector holder 22 and projects toward the cover body 10 from the noise shielding layer 30. The bulged portion 42 is located inside the cover recess 14. Both the space 41 and the bulged portion 42 are less electrically conductive than the cover body 10 and the noise shielding layer 30 made of electrically conductive metal.

As shown in FIGS. 2 and 3, in the present embodiment, the noise shielding layer 30 covers a part of the cover recess 14, not the entire cover recess 14. Therefore, as shown in FIG. 2, the cover 1 has a communicating part 43 that allows the space 41 and the interior of the case 101 to communicate with each other. In the present embodiment, an outer edge 14*b* of the inner face 14*a* of the cover recess 14 is inclined with respect to the noise shielding layer 30, and the outer edge 14*b* is not parallel with the noise shielding layer 30.

As shown in FIGS. 1 to 4, the interlock connector 20 includes the connector body 21 and the connector holder 22. The connector body 21 is removably held by the connector holder 22, whereby the interlock connector 20 is formed. The connector body 21 is configured to be electrically connectable to the receptacle connector 103 as shown in FIG. 4. The connector body 21 has the engagement rib 211, the engagement claw 212, and a connection hole 213 as shown in FIGS. 2 and 3. The connector body 21 is made of resin and has an insulating property.

The engagement rib 211 is provided at one end of the connector body 21 and is engaged with the slit 221 of the connector holder 22 as described above. The engagement claw 212 is formed at a position on the connector body 21 that faces the connector holder 22, and is movable in a direction away from the connector holder 22. The engagement claw 212 has the rising face 212*a* and an inclined face 212*b*. The rising face 212*a* is parallel with the direction away from the connector holder 22. The inclined face 212*b* is opposite to the rising face 212*a* and is inclined with respect to the direction away from the connector holder 22.

Figure 5:
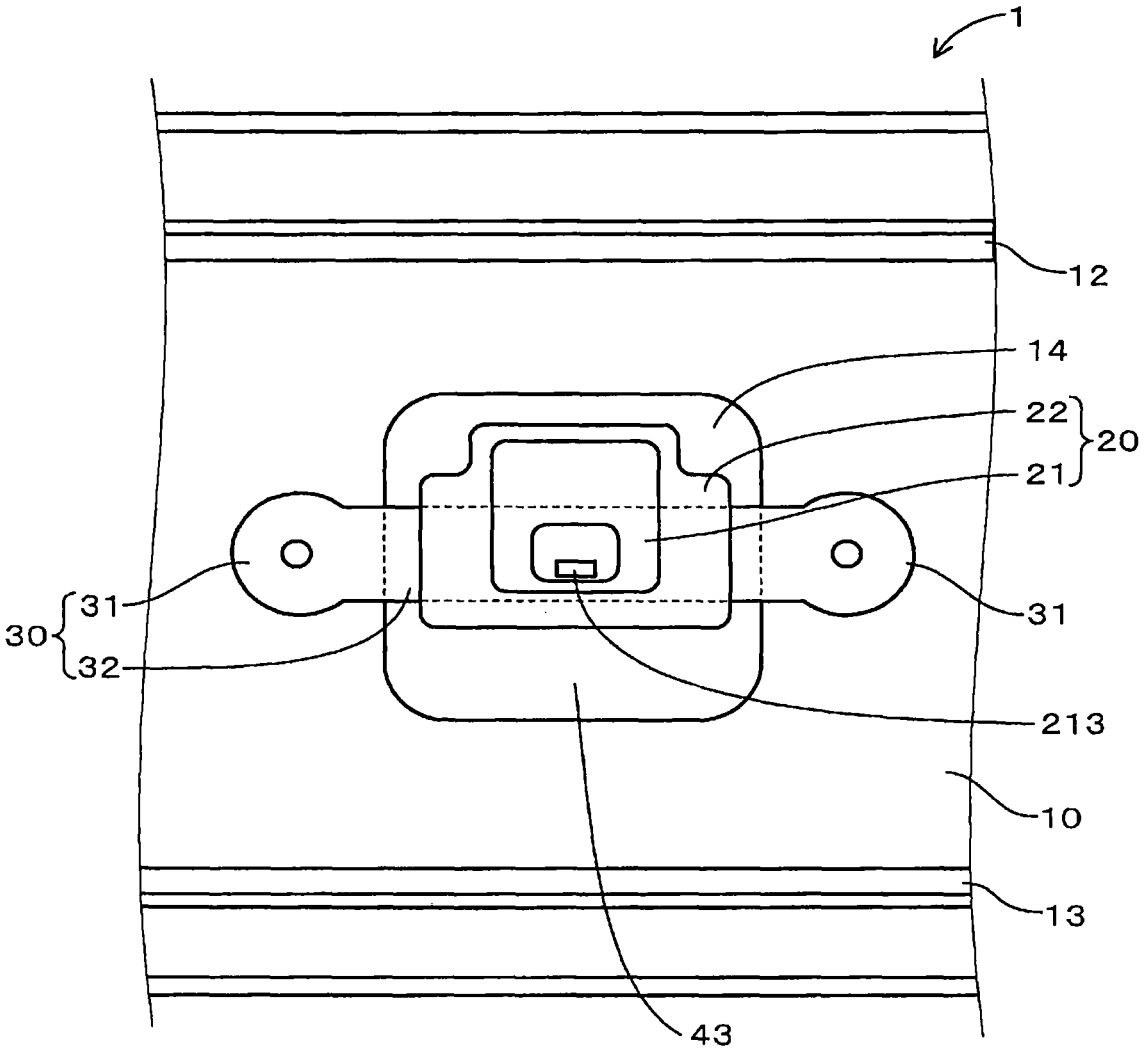
FIG. 5 is an enlarged rear view of the cover with an interlock connector according to the first embodiment.

The connection hole 213 is provided at the other end of the connector body 21 and is configured to allow a connection pin 104 of the receptacle connector 103 provided in the case 101 to be inserted thereinto. As shown in FIG. 5, the connection hole 213 is located at a position on the noise shielding layer 30 when viewed in the layer direction of the cover body 10 and the noise shielding layer 30.

For attaching the connector body 21 to the connector holder 22, the engagement rib 211 is inserted into the slit 221 as shown in FIG. 3, and the inclined face 212*b* of the engagement claw 212 slides over the first protrusion 223 as shown in FIG. 2. As a result, the rising face 212*a* of the engagement claw 212 faces the first protrusion 223 of the connector holder 22, and the first side face 27 of the connector body 21 faces the second protrusion 224 of the connector holder 22. Gaps are provided between the rising face 212*a* and the first protrusion 223 and between the first side face 27 and the second protrusion 224.

As shown in FIG. 3, gaps are also provided between an inner face 222 of the slit 221 and the engagement rib 211 and between second and third side faces 28 and 29 of the connector body 21 and a face 225 of the slit 221 that faces the second and third side faces 28 and 29. These gaps cause the connector body 21 of the interlock connector 20 to be loosely fit in the connector holder 22, so that the connector body 21 is movable in the planar direction of the cover body 10. In the present embodiment, the movement of the connector body 21 is allowed in such a range that the connection hole 213 is always on the noise shielding layer 30 when viewed in the layer direction of the cover body 10 and the noise shielding layer 30 as shown in FIG. 5.

Inside the connector body 21, a connection terminal (not illustrated) is provided. The connection terminal is electrically connected to the connection pin 104 (shown in FIG. 4) inserted into the connection hole 213. Once the connection terminal and the connection pin 104 are electrically connected to each other, the attachment of the cover 1 to the opening 102 in the case 101 can be detected.

Next, the effects of the cover 1 according to the present embodiment will be described in detail.

According to the cover 1 of the present embodiment, the electrically conductive noise shielding layer 30 and the low conductivity layer 40 are formed between the cover body 10 and the interlock connector 20. The low conductivity layer 40 is closer to the cover body 10 than the noise shielding layer 30 is, and is less electrically conductive than the cover body 10 and the noise shielding layer 30.

Figure 6:
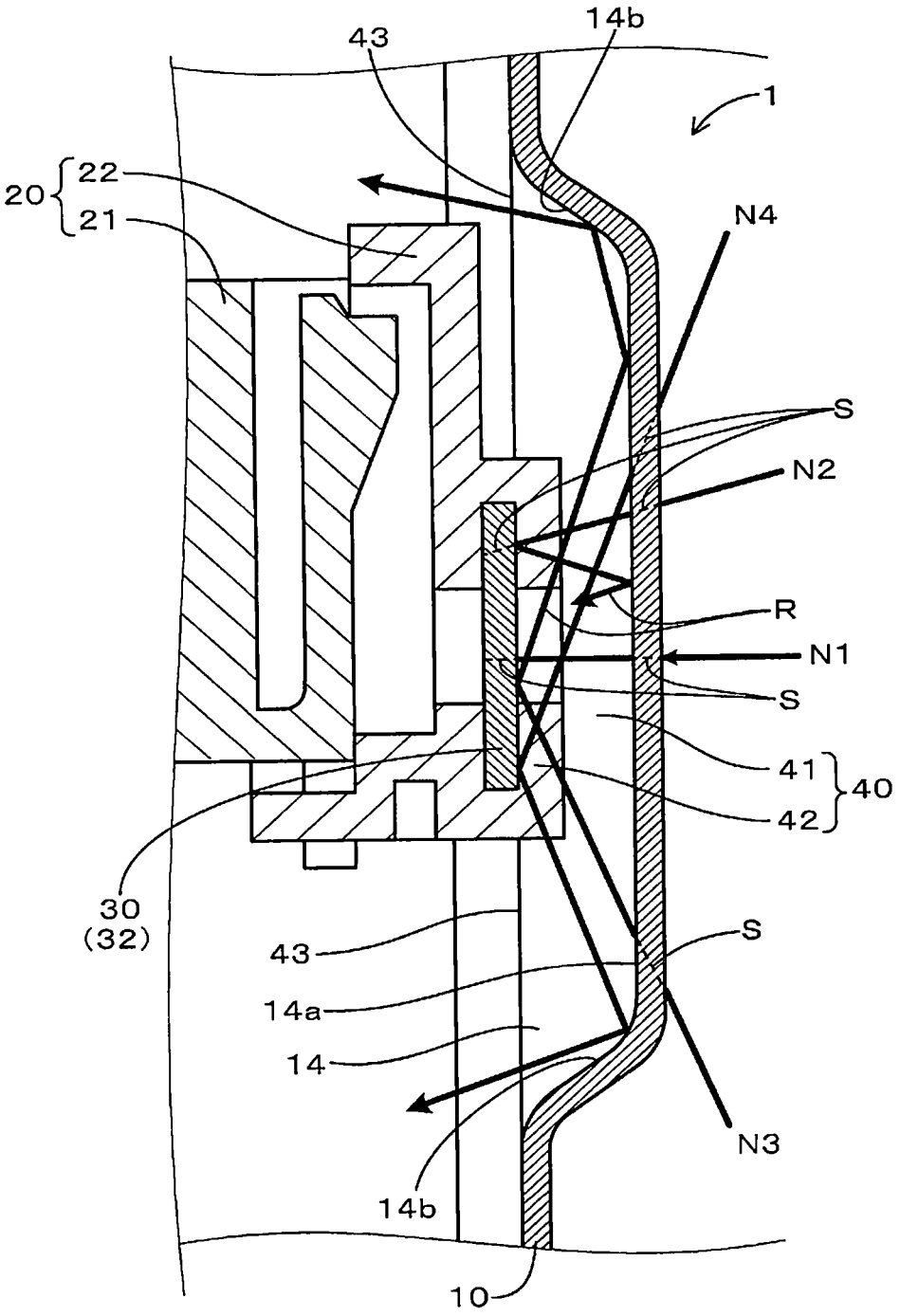
FIG. 6 is a schematic view for explaining usage according to the first embodiment.

As a result, as shown in FIG. 6, the synergy of internal attenuation S through the cover body 10 and the noise shielding layer 30 and reflection R that occurs in the low conductivity layer 40 between the noise shielding layer 30 and the cover body 10 prevents external noises N1, N2, N3, and N4 from reaching the interlock connector 20. As a result, noise resistance is improved, and false detection of the open/closed state of the cover 1 is prevented. Further, the cover body 10 does not require an excessively large thickness. Thus, the cover 1 can have a small size.

In the present embodiment, the cover 1 is mounted in a vehicle that has relatively much low-frequency noise. Thus, reflection at the low conductivity layer 40 can effectively prevent the external noise from reaching the interlock connector 20, and false detection of the open/closed state of the cover 1 can be reliably prevented.

In the present embodiment, the noise shielding layer 30 has the connection parts 31 connected to the cover body 10 and the separation part 32 separated from the cover body 10 for providing the low conductivity layer 40. As a result, external noise can be reflected between the separation part 32 and the cover body 10 and can also propagate to the cover body 10 through the connection parts 31 while being attenuated through the noise shielding layer 30. Therefore, external noise can be reliably prevented from reaching the interlock connector 20.

In the present embodiment, at least a part of the low conductivity layer 40 includes the space 41 formed between the separation part 32 and the cover body 10. As a result, the low conductivity layer 40 can be formed with a simple configuration, so that the manufacturing cost can be reduced, and the efficiency of assembly work is expected to improve.

In the present embodiment, the connection parts 31 are joined by clinching to the cover body 10 by being laid on and deformed integrally with the cover body 10. As a result, the noise shielding layer 30 can be firmly fixed to the cover body 10 with a simple configuration. Further, the projections 15 projecting to the outside of the case 101 can be formed on the cover body 10 and the noise shielding layer 30, so that the surface area of the cover body 10 and the noise shielding layer 30 can be increased.

As a result, reflection of external noise can be facilitated, and noise resistance can be improved. The clinch joining does not require any through holes in the area inside the gasket 12, which can maintain the seal between the cover 1 and the case 101. Another possible method for connecting the connection parts 31 and the cover body 10 is spot welding. In this case, however, the plating provided on the cover body 10 is liable to peel off. In contrast, the clinch joining in the present embodiment is free from plating to peel off.

In the present embodiment, the clinch joining at the connection parts 31 forms the projections 15 projecting to the outside of the case 101. Alternatively, projections projecting to the inside of the case 101 may be formed. The effects of this alternative configuration are equivalent to those of the present embodiment.

In the present embodiment, the cover 1 has the communicating part 43 that allows the low conductivity layer 40 and the interior of the case 101 to communicate with each other. As a result, as shown in FIG. 6, the external noises N3 and N4 that have reached the low conductivity layer 40 are let out of the low conductivity layer 40 through the communicating part 43. Thus, the external noises N3 and N4 can be prevented from staying in the low conductivity layer 40.

In the present embodiment, the interlock connector 20 is attached to the cover body 10 via the noise shielding layer 30 in a state where the the interlock connector 20 is integrally molded with at least a part of the noise shielding layer 30, and a part of the interlock connector 20, namely the bulged portion 42, is located between the noise shielding layer 30 and the cover body 10 to form at least a part of the low conductivity layer 40.

As a result, the bulged portion 42, a part of the interlock connector 20, can be used as the low conductivity layer 40, so that both securing of the low conductivity layer 40 and downsizing can be achieved. Although the low conductivity layer 40 in the present embodiment includes the bulged portion 42 and the space 41, the low conductivity layer 40 may include only the bulged portion 42, without the space 41.

In the present embodiment, the cover body 10 has the cover recess 14 with a recess shape on the side facing the opening 102. The noise shielding layer 30 includes a plate-like member that covers at least a part of the cover recess 14. The low conductivity layer 40 is formed between the noise shielding layer 30 and the inner face 14*a* of the cover recess 14. The bulged portion 42, a part of the interlock connector 20, is located inside the cover recess 14.

As a result, a clearance space for providing the bulged portion 42 can be provided in the cover body 10. Therefore, both securing of the low conductivity layer 40 and downsizing can be achieved. Further, the plate-like member that forms the noise shielding layer 30, with which the interlock connector 20 is integrally molded, can be connected to the cover body 10 without being bent. Thus, the accuracy of the attachment position of the interlock connector 20 can be improved.

In the present embodiment, at least a part of the inner face of the cover recess 14, namely the outer edge 14*b*, is not parallel with the noise shielding layer 30. As a result, as shown in FIG. 6, the external noises N3 and N4 are likely to be reflected in different directions at the low conductivity layer 40 formed between the noise shielding layer 30 and the inner face 14*a* of the cover recess 14, which can hinder the external noises N3 and N4 from reaching the interlock connector 20.

In the present embodiment, the inner face 14*a* of the cover recess 14 is parallel with the noise shielding layer 30 except at the outer edge 14*b*. Alternatively, not only the outer edge 14*b* but also the other area of the inner face 14*a* may be nonparallel with the noise shielding layer 30. In this case, external noise is reliably reflected in different directions at the low conductivity layer 40 formed between the noise shielding layer 30 and the inner face 14*a* of the cover recess 14, which can reliably hinder the external noise from reaching the interlock connector 20.

In the present embodiment, the interlock connector 20 includes the connector body 21 configured to be electrically connectable to the receptacle connector 103 and the connector holder 22 that holds the connector body 21, in which the connector holder 22 is integrally molded with at least a part of the noise shielding layer 30. The bulged portion 42, a part of the connector holder 22, forms at least a part of the low conductivity layer 40. Although the connector body 21 and the connector holder 22, which is integrally molded with a part of the noise shielding layer 30, are two separate components, the connector holder 22 can be attached to the cover body 10 just by attaching the noise shielding layer 30 to the cover body 10.

Thus, the efficiency of assembly work is improved. In addition, the connector body 21 can be replaced independently, which is advantageous in terms of cost. The bulged portion 42, a part of the connector holder 22, can be used as the low conductivity layer 40, which contributes to reducing the size of the cover 1.

In the present embodiment, the connector body 21 is movably held by being loosely fit in the connector holder 22. As a result, when the cover 1 is attached to the case 101, any attachment misalignment or any misalignment caused by the shape tolerance of each member is absorbed, which ensures that the interlock connector 20 is connected to the receptacle connector 103. As a result, false detection of the open/closed state of the cover 1 can be reliably prevented.

In the present embodiment, the movement of the connector body 21 is allowed in such a range that the connection hole 213 is always on the noise shielding layer 30 when viewed in the layer direction of the cover body 10 and the noise shielding layer 30. As a result, regardless of the position of the connector body 21, the synergy of internal attenuation at the noise shielding layer 30 and the cover body 10 and reflection at the low conductivity layer 40 can prevent external noise from reaching the connection hole 213 in the interlock connector 20, so that false detection of the open/closed state of the cover 1 can be reliably prevented.

In the present embodiment, the connector holder 22 is attached to the cover body 10 via the noise shielding layer 30 in a state where the connector holder 22 is integrally molded with a part of the noise shielding layer 30. As a result, the connector holder 22 can be attached to the cover body 10 just by attaching the noise shielding layer 30 to the cover body 10. Thus, the efficiency of assembly work is improved, and the number of components is reduced.

Although the single noise shielding layer 30 is provided in the present embodiment, a plurality of noise shielding layers 30 may be stacked so that two or more noise shielding layers 30 are provided. In this case, the stacked noise shielding layers 30 are separated from each other to form low conductivity layers 40 that are less electrically conductive than the noise shielding layers 30. As a result, reflection of external noise at the plurality of low conductivity layers 40 and internal attenuation through the plurality of noise shielding layers 30 can reliably prevent the external noise from reaching the interlock connector 20.

Although a plate-like member made of metal is used as the noise shielding layer 30 in the present embodiment, any electrically conductive material may be used as the noise shielding layer 30, such as glass wool or a metallic porous body. The use of glass wool or a metallic porous body as the noise shielding layer 30 can cause reflection of external noise in the noise shielding layer 30, and the effect of shielding low-frequency noise is expected to improve.

Figure 7:
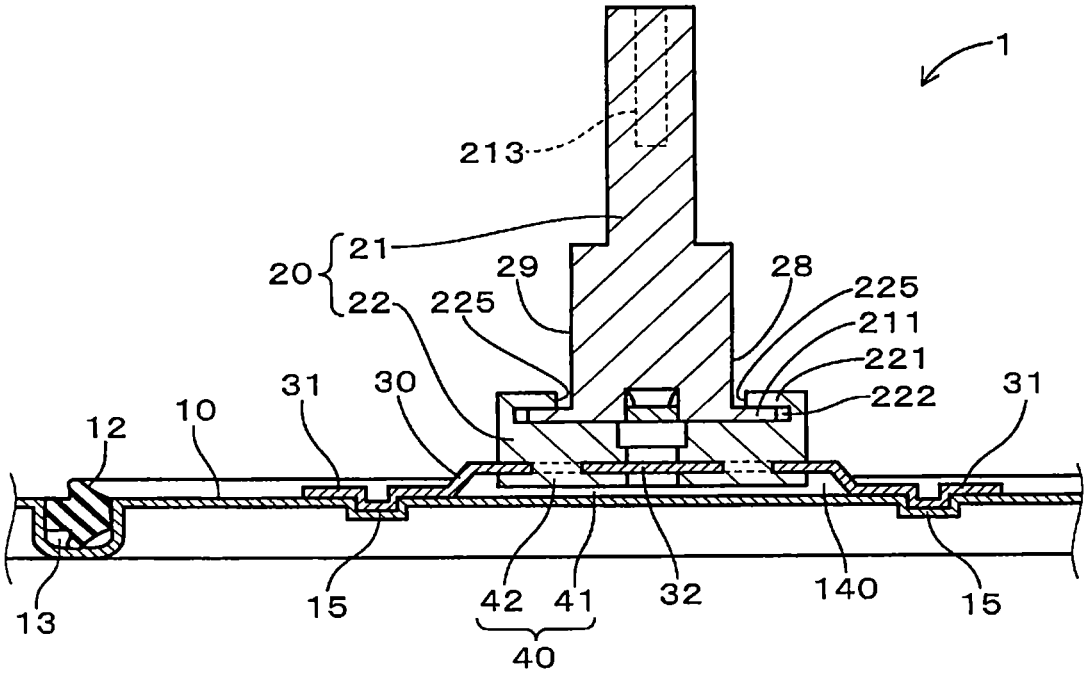
FIG. 7 is a cross-sectional view taken along line III-III in FIG. 1 according to the first modification.

In the present embodiment, the cover recess 14 is provided in the cover body 10. Alternatively, in the first modification, the cover body 10 may be a flat plate, and the plate-like member that forms the noise shielding layer 30 may be bent to form a shield recess 140 with a recess shape with respect to the cover body 10 as shown in FIG. 7. In the first modification, the shield recess 140 forms the low conductivity layer 40 including the space 41 and the bulged portion 42 between the cover body 10 and the noise shielding layer 30. The effects of the first modification are equivalent to those of the present embodiment, except for the effect of the present embodiment obtained by providing the cover recess 14 in the cover body 10.

Figure 8:
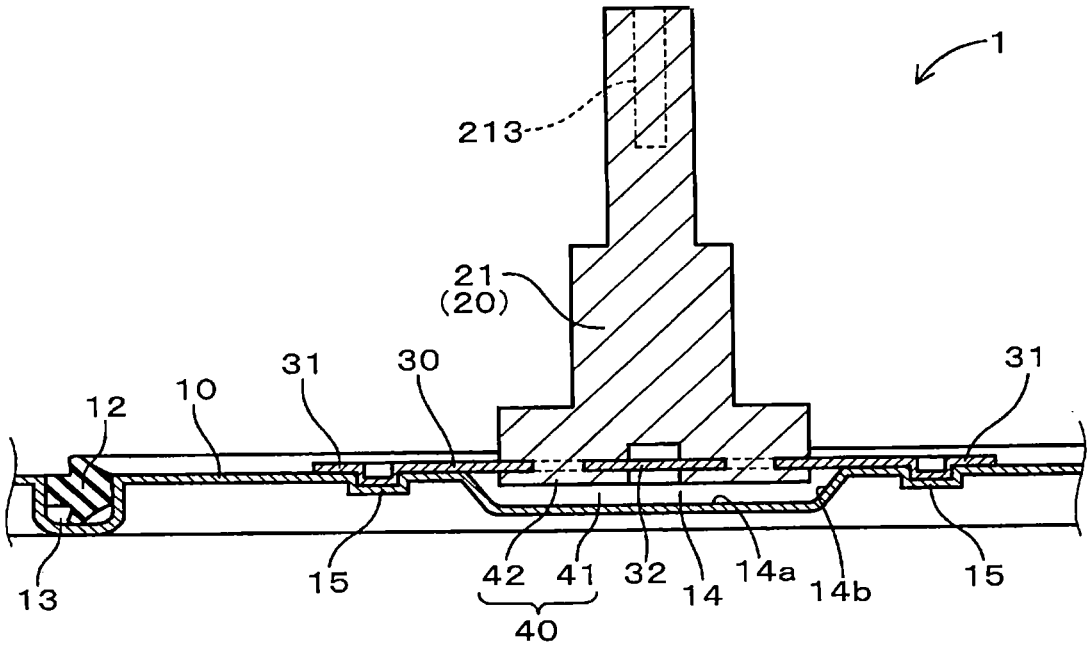
FIG. 8 is a cross-sectional view taken along line III-III in FIG. 1 according to the second modification.

In the cover 1 according to the present embodiment, the interlock connector 20 includes the connector body 21 and the connector holder 22, and the connector body 21 is movably held by being loosely fit in the connector holder 22. Alternatively, as in the second modification shown in FIG. 8, the interlock connector 20 may be configured without the connector holder 22 such that the connector body 21 is directly and integrally molded with the noise shielding layer 30. In this case, the receptacle connector 103 (see FIG. 4) may be movable. The effects of the second modification are equivalent to those of the present embodiment, except for the effect of the present embodiment obtained by forming the interlock connector 20 with the connector body 21 and the connector holder 22.

In the present embodiment, the cover 1 is configured to cover the opening 102 formed in the case 101 so that the work of fastening a bolt to the high-voltage terminal block 105 provided in the power conversion device 100 can be conducted. Alternatively, the cover 1 may be configured to cover another opening in the case 101 which requires detection of its open/closed state.

As described above, the present embodiment can provide the cover 1 that prevents false detection of its open/closed state and can have a small size.

The present disclosure is not limited to the above embodiment and modifications, and can be applied to various embodiments without departing from the gist of the disclosure.

The present disclosure has been described with reference to the embodiment, but it is to be understood that the present disclosure is not limited to the embodiment and structures. The present disclosure covers various modifications and equivalent variations. In addition to various combinations and forms, other combinations and forms including one or more/less elements thereof are also within the spirit and scope of the present disclosure.

What is claimed is:

1. A cover comprising:

a cover body that is electrically conductive and covers an opening provided in a case of a power conversion device;

an interlock connector that is electrically connectable to a receptacle connector provided inside the case;

a noise shielding layer that is formed between the cover body and the interlock connector, the noise shielding layer being electrically conductive; and a low conductivity layer that is formed between the cover body and the interlock connector, wherein the low conductivity layer is less electrically conductive than the cover body and the noise shielding layer, and is closer to the cover body than the noise shielding layer is.

2. The cover according to claim 1, further comprising:

a communicating part that allows the low conductivity layer and an interior of the case to communicate with each other.

3. The cover according to claim 1, wherein:

the interlock connector is attached to the cover body via the noise shielding layer in a state where the interlock connector is integrally molded with at least a part of the noise shielding layer; and a part of the interlock connector is located between the noise shielding layer and the cover body to form at least a part of the low conductivity layer.

4. The cover according to claim 1, wherein:

the noise shielding layer includes connection parts connected to the cover body and a separation part separated from the cover body for providing the low conductivity layer.

5. The cover according to claim 4, wherein the connection parts are joined by clinching to the cover body by being laid on and deformed integrally with the cover body.

6. The cover according to claim 4, wherein:

at least a part of the low conductivity layer includes a space formed between the separation part and the cover body.

7. The cover according to claim 6, wherein:

the connection parts are joined by clinching to the cover body by being laid on and deformed integrally with the cover body.

8. The cover according to claim 7, further comprising:

a communicating part that allows the low conductivity layer and an interior of the case to communicate with each other.

9. The cover according to claim 8, wherein:

the interlock connector is attached to the cover body via the noise shielding layer in a state where the interlock connector is integrally molded with at least a part of the noise shielding layer; and a part of the interlock connector is located between the noise shielding layer and the cover body to form at least a part of the low conductivity layer.

10. The cover according to claim 9, wherein:

the interlock connector includes a connector body configured to be electrically connectable to the receptacle connector, and a connector holder that holds the connector body, wherein the connector holder is integrally molded with at least a part of the noise shielding layer, and a part of the connector holder forms at least a part of the low conductivity layer.

11. The cover according to claim 9, wherein:

the cover body has a cover recess with a recess shape on a side facing the opening;

the noise shielding layer includes a plate-like member that covers at least a part of the cover recess;

the low conductivity layer is formed between the noise shielding layer and an inner face of the cover recess; and the part of the interlock connector is located inside the cover recess.

12. The cover according to claim 11, wherein:

at least a part of the inner face of the cover recess is not parallel with the noise shielding layer.

13. The cover according to claim 12, wherein:

the interlock connector includes a connector body configured to be electrically connectable to the receptacle connector, and a connector holder that holds the connector body, wherein the connector holder is integrally molded with at least a part of the noise shielding layer, and a part of the connector holder forms at least a part of the low conductivity layer.

14. The cover according to claim 13, wherein:

the connector body is movably held by being loosely fit in the connector holder.

* * * * *